US009995026B2

(12) United States Patent
Booth et al.

(10) Patent No.: US 9,995,026 B2
(45) **Date of Patent: *Jun. 12, 2018**

(54) MOUNTING SYSTEM FOR SINK

(71) Applicant: Kohler Co., Kohler, WI (US)

(72) Inventors: Shawn J. Booth, Sheboygan, WI (US); Jason R. Miller, Sheboygan Falls, WI (US); James S. Giefer, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 9 days.

This patent is subject to a terminal disclaimer.

(21) Appl. No.: 15/296,834

(22) Filed: Oct. 18, 2016

(65) Prior Publication Data

US 2017/0037606 A1 Feb. 9, 2017

Related U.S. Application Data

(63) Continuation of application No. 13/325,768, filed on Dec. 14, 2011, now Pat. No. 9,492,010.

(Continued)

(51) Int. Cl.

| | |
|---|---|
| ***E03C 1/33*** | (2006.01) |
| ***A47B 77/06*** | (2006.01) |
| *E03C 1/18* | (2006.01) |

(52) U.S. Cl.

CPC ..... *E03C 1/335* (2013.01); *A47B 77/06* (2013.01); *E03C 1/33* (2013.01); *E03C 1/18* (2013.01);

(Continued)

(58) Field of Classification Search

CPC ... E03C 1/32; E03C 1/33; E03C 1/335; A47B 77/00; A47B 77/06; A47B 77/08; A47B 77/022; A47L 17/02

(Continued)

(56) References Cited

U.S. PATENT DOCUMENTS

| | | | |
|---|---|---|---|
| 2,023,692 | A | 12/1935 | McQuinn |
| 2,035,301 | A | 3/1936 | Daugherty |

(Continued)

FOREIGN PATENT DOCUMENTS

| | | |
|---|---|---|
| BE | 483814 | 7/1948 |
| CA | 2622792 | 9/2009 |

(Continued)

OTHER PUBLICATIONS

Notice of First Office Action in related CN Application No. 201280021521.4.

(Continued)

*Primary Examiner* — Erin Deery
(74) *Attorney, Agent, or Firm* — Foley & Lardner LLP

(57) ABSTRACT

A sink assembly mountable to a support structure having a cabinet and a countertop supported by the cabinet. The sink assembly includes a sink having at least one basin, a rim that is above and extends outwardly beyond the at least one basin, an apron that extends laterally across and beyond a front of the at least one basin, and a receiving member coupled to a first underside of the sink. The sink assembly includes a bracket having a first portion, which engages a portion of the cabinet, and a second portion, which engages a second underside of the sink. The sink assembly includes a connecting member configured to extend between and couple to the receiving member and the bracket to secure the sink to the support structure.

20 Claims, 12 Drawing Sheets

Related U.S. Application Data

(60) Provisional application No. 61/449,589, filed on Mar. 4, 2011.

(52) U.S. Cl.
CPC .... *Y10T 29/49826* (2015.01); *Y10T 29/49947* (2015.01)

(58) Field of Classification Search
USPC ..... 4/631–635, 348, 649; 248/201, 298.1, 248/146, 149, 312.1; 312/228
See application file for complete search history.

(56) References Cited

U.S. PATENT DOCUMENTS

| | | | |
|---|---|---|---|
| 2,505,828 | A | 5/1950 | Fox |
| 2,629,880 | A | 2/1953 | Hartog |
| 2,646,575 | A | 7/1953 | Galley |
| 2,818,579 | A | 1/1958 | Katz |
| 2,878,091 | A | 3/1959 | Hammond |
| 2,897,516 | A | 8/1959 | Ensch |
| 2,996,730 | A | 8/1961 | Hornik |
| 3,001,209 | A | 9/1961 | Hammer |
| 3,029,446 | A | 4/1962 | Just |
| 3,040,338 | A | 6/1962 | Zeleny et al. |
| 3,051,160 | A | 8/1962 | Nielsen |
| 3,095,580 | A | 7/1963 | Just |
| 3,231,903 | A | 2/1966 | Cope |
| 3,813,707 | A | 6/1974 | Fowell |
| 4,002,383 | A | 1/1977 | Holloway, Jr. |
| 4,016,608 | A | 4/1977 | Khan |
| 4,878,257 | A | 11/1989 | Hardin |
| D313,068 | S | 12/1990 | Kohler et al. |
| 5,016,297 | A | 5/1991 | Sauter et al. |
| 5,070,554 | A | 12/1991 | Bertoli |
| 5,201,306 | A | 4/1993 | Kinny |
| D353,652 | S | 12/1994 | Dannenberg |
| D394,487 | S | 5/1998 | Wilson |
| 5,931,151 | A | 8/1999 | Van Dore et al. |
| 6,564,398 | B1 | 5/2003 | Trott |
| 6,745,416 | B2 | 6/2004 | Albarran |
| 6,782,593 | B1 | 8/2004 | Shimony |
| 6,785,918 | B2 | 9/2004 | Romo |
| 6,793,190 | B2 | 9/2004 | White et al. |
| D498,520 | S | 11/2004 | Rachiele |
| D501,541 | S | 2/2005 | Gordon |
| D518,560 | S | 4/2006 | Arkay-Leliever |
| D524,078 | S | 7/2006 | Bruce |
| D558,311 | S | 12/2007 | Adams |
| D700,301 | S | 2/2014 | Rachiele |
| 2006/0195981 | A1 | 9/2006 | Yemini |
| 2008/0196158 | A1 | 8/2008 | Jones et al. |
| 2008/0313804 | A1 | 12/2008 | Osterroth et al. |
| 2010/0301175 | A1 | 12/2010 | Grayson |

FOREIGN PATENT DOCUMENTS

| | | |
|---|---|---|
| DE | 8535539 | 2/1986 |
| DE | 40 34 926 | 5/1991 |
| DE | 102006006404 | 8/2007 |
| EP | 1598489 | 11/2005 |
| EP | 2 088 250 | 2/2009 |
| FR | 2632838 | 12/1989 |

OTHER PUBLICATIONS

International Search Report regarding Application No. PCT/US2012/027306 dated Sep. 10, 2013.

International Search Report regarding Application No. PCT/US2012/027318 dated Sep. 10, 2013.

International Search Report regarding Application No. PCT/US2012/027303 dated Sep. 10, 2013.

International Search Report and Written Opinion dated Jun. 26, 2012 in International Application No. PCT/US2012/027303.

MOUNTING SYSTEM FOR SINK

CROSS-REFERENCE TO RELATED PATENT APPLICATIONS

This application is a Continuation of U.S. patent application Ser. No. 13/325,768, filed Dec. 14, 2011 and issued Oct. 26, 2016 as U.S. Pat. No. 9,492,010, which claims the benefit of and priority to U.S. Provisional Patent Application No. 61/449,589, filed Mar. 4, 2011. The foregoing U.S. applications are incorporated by reference herein in their entireties.

BACKGROUND

The present disclosure relates generally to the field mounting systems used to secure a sink to a support structure. More specifically, the present disclosure relates to mounting systems used to secure a self-rimming sink to a support structure.

Sinks are vessels generally configured for receiving water. Usually, a faucet or other water source is located proximate to the sink, and a drain pipe is coupled to the sink to remove unwanted water. A sink is often mounted on or into a cabinet, stand, or pedestal. A sink may be mounted such that a rim of the sink rests on top of a countertop of a cabinet. This is generally referred to as a self-rimming sink.

One continuing challenge in the field of self-rimming sinks relates to the way in which a self-rimming sink is attached to a support structure. Usually, a self-rimming sink is attached to a support structure by requiring an installer to reach up along the side of the sink to tighten a fastener for securing the rim to a countertop. The fasteners are often difficult to reach and see. Further, providing clearance for the hand and/or tool of the installer often requires reducing the width of the basin. Other methods of coupling a self-rimming sink tend to pull down on the sink basin thereby warping the rim and/or lifting the edge of the rim from the countertop.

The challenge of attaching a self-rimming sink to a support structure is particularly an issue for a self-rimming apron-front sink. An apron-front sink, which includes farmhouse sinks, has an exposed and substantially vertical panel extending laterally across a front portion of the sink. Another continuing challenge in the field of apron-front sinks relates to fitting the sink into the support structure. Installation of an apron-front sink usually requires precise and repeated cuts to fit the sink to the front of the cabinet without leaving unsightly gaps between the apron and the cabinet. This custom fitting method takes time and requires an installer to repeatedly lift a heavy sink to check for fit.

A further continuing challenge in the field of apron-front sinks relates to retrofitting. Usually apron-front sinks will not fit into "standard," "stock," or "off-the-shelf" non-apron-front cabinetry due to the width of the sink and the height of the cabinet's lower doors. Alternatively, such retrofits require extensive modifications to the cabinet or installation of an undersized sink.

SUMMARY

One embodiment relates to a mounting system for securing a sink to a countertop supported by a cabinet. The mounting system includes a receiving structure configured to be supported under a rim of the sink, a bracket having a first portion configured to engage a portion of the cabinet and a second portion configured to engage a bottom of a basin of the sink, a linking member extending between the receiving structure and the bracket, a first connector configured to engage a first end of the linking member and retain the linking member relative to the receiving structure, and a second connector configured to engage a second end of the linking member and secure the bracket against the cabinet and the bottom of the basin of the sink.

Another embodiment relates to a sink configured to be supported by a cabinet. The sink includes at least one basin, a rim outwardly extending from an upper end of the basin, and a mounting system for securing the sink to the cabinet. The mounting system includes a receiving structure configured to be supported under a rim of the sink, a bracket having a first portion configured to engage a portion of the cabinet and a second portion configured to engage a bottom of a basin of the sink, a linking member extending between the receiving structure and the bracket, a first connector configured to engage a first end of the linking member and retain the linking member relative to the receiving structure, and a second connector configured to engage a second end of the linking member and secure the bracket against the cabinet and the bottom of the basin of the sink.

Another embodiment relates to a method of securing a self-rimming sink relative to a countertop, the self rimming sink having a floor, a sidewall extending generally upward from the floor, and a rim extending outward from the sidewall, the sink having a channel coupled to an underside of the rim, the sink at least partially supported by a base cabinet, the base cabinet having a projection. The method includes the steps of inserting an linking member into the channel, positioning a bracket about a lower end of the linking member that a first lateral end of the bracket engages the floor of the sink and a second lateral end of the bracket engages the projection of the base cabinet, and coupling a securing mechanism to the lower end of the link member to at least partially secure the bracket relative to the base cabinet and the sink.

DETAILED DESCRIPTION

Referring generally to the FIGURES, a mounting system and components thereof for clamping or otherwise securing a sink to a support structure are shown according to exemplary embodiments. The mounting systems may be particularly suitable for use with self-rimming sinks or basins in which the sink is inserted through an opening in the support structure (e.g., countertop, base cabinet, vanity, etc.) and a rim of the sink overlays a top portion of the support structure (e.g., countertop, etc.) to at least partially support the sink. The mounting systems may be used to install self-rimming sinks, or any other sinks, in various environments including kitchens, bathrooms, utility rooms or any other location where it may be desirable to install a sink.

Before discussing further details of the mounting systems, the sinks and/or the components thereof, it should be noted that references to "front," "back," "rear," "upper," "lower," "right," and "left" in this description are merely used to identify the various elements as they are oriented in the FIGURES, with "right," "left," "front," "back," and "rear" being relative to a user facing the sink, and with "lateral" being left-right as viewed by the user. These terms are not meant to limit the element which they describe, as the various elements may be oriented differently in various applications.

It should further be noted that for purposes of this disclosure, the term coupled means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Figure 1:
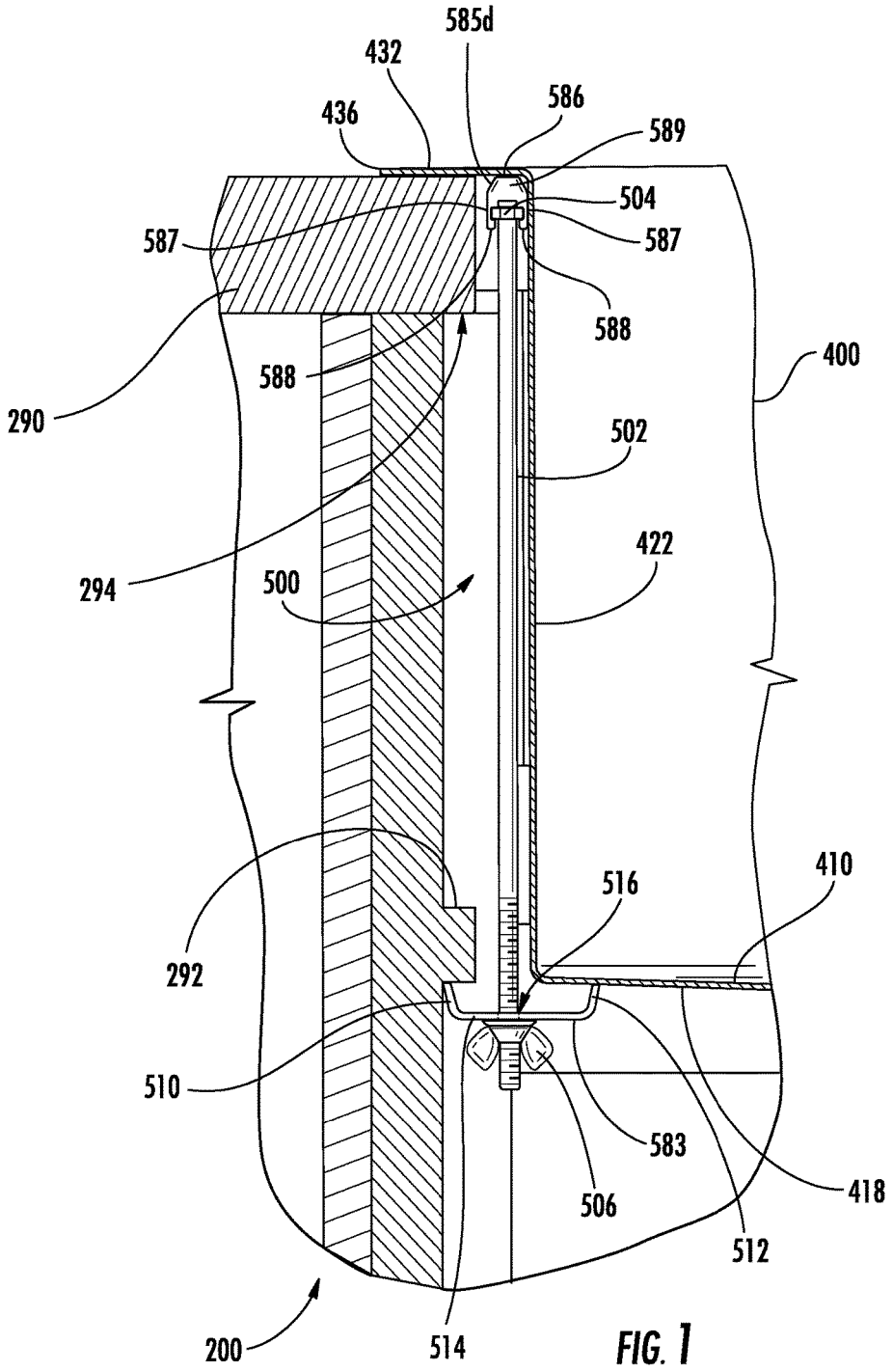
FIG. 1 is a cross sectional view of a sink assembly showing a mounting system according to an exemplary embodiment taken along a line 1-1 of FIG. 8.
Figure 2:
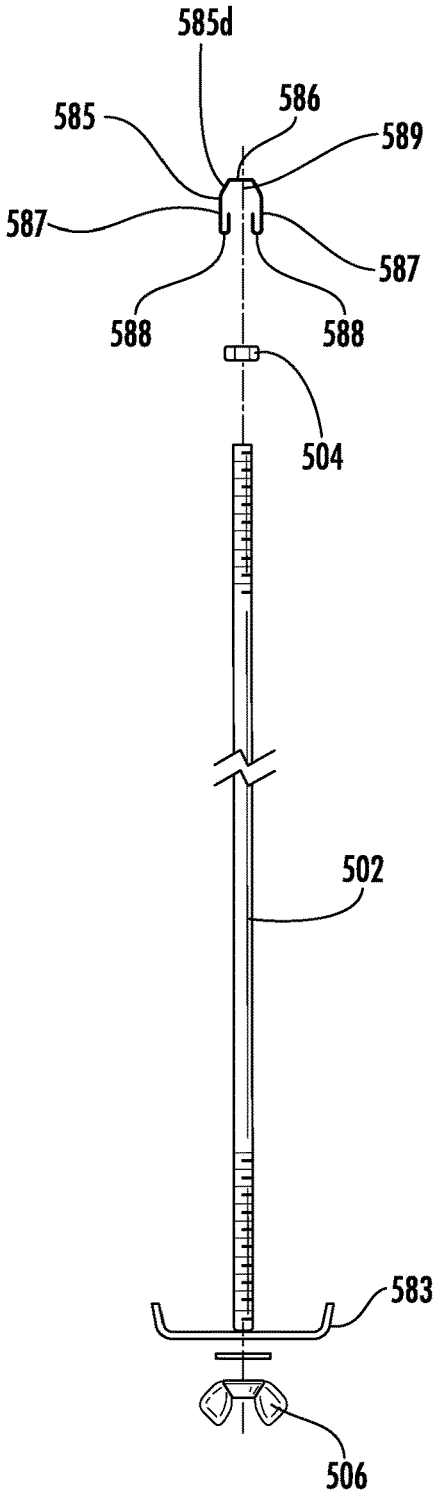
FIG. 2 is an exploded of the mounting system of FIG. 1.
Figure 3:
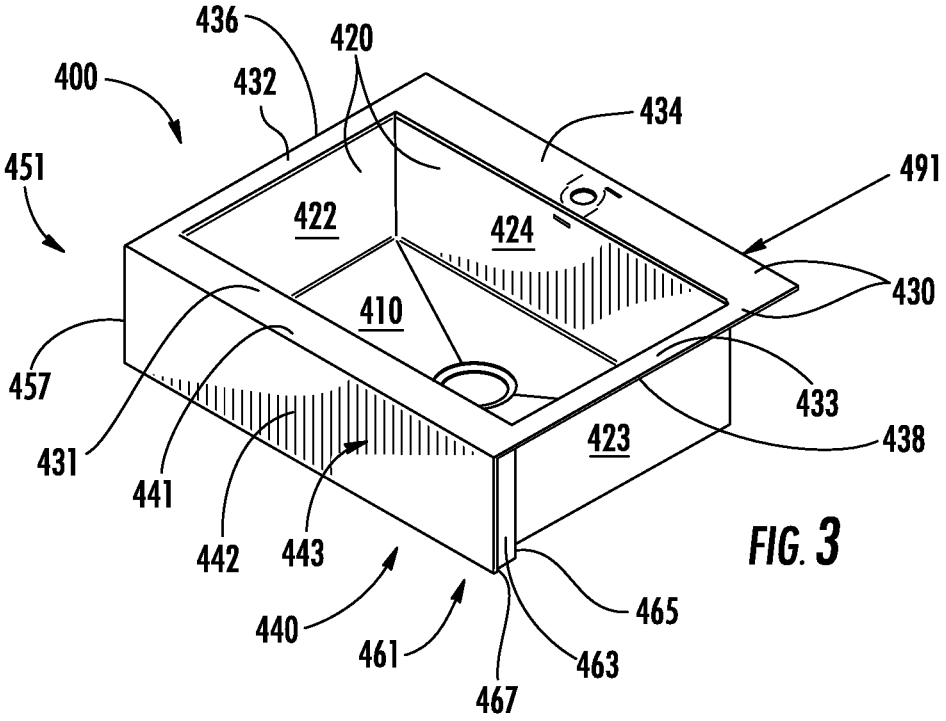
FIG. 3 is a top perspective view of a self-rimming sink according to an exemplary embodiment.

Referring to FIGS. 1 and 2, a mounting system 500 is shown according to an exemplary embodiment. Mounting system 500 is configured to securely retain a sink 400 to a support structure 200 (e.g., countertop, cabinet, vanity, table, etc.). To facilitate the mounting of sink 400 to support structure 200, mounting system 500 generally includes a first member (e.g., receiving member, rail, conduit, etc.), shown as a channel 585, a second member (e.g., connector, enlarged head, nut, clip, etc.), shown as a first fastener 504, a third member (e.g., connector, tie-rod, bar, etc.), shown as a linking member 502, a fourth member (e.g., clip, plate, strap, etc.), shown as a bracket 583 and a fifth member (e.g., connector, nut, clip, etc.), shown as a second fastener 506. Channel 585 is configured to be coupled to or supported at an underside of a rim of sink 400 (e.g., the underside of a rim of sink 400, etc.), while bracket 583 includes a first portion configured to engage a portion of support structure 200 (e.g., projection, cleat, etc.) and a second portion configured to engage a bottom (e.g., floor, etc.) of a basin of sink 400. Linking member 502 is an elongated member configured to extend between channel 585 and bracket 583. First fastener 504 is received within and/or retained by channel 585 and configured to engage a first end of linking member 502. Second fastener 506 configured to engage an opposite second end of linking member 502 and secure bracket 583 against support structure 200 and sink 400. Once mounting system 500 is in place, tightening of second fastener 506 against bracket 583 creates a downward force on first fastener 504 which is transferred to channel 585 and ultimately to the rim of sink 400. Positioning first fastener 506 below bracket 583, which is below the basin floor of sink 400, provides first fastener 506 at a location that may be easily accessible to an installer during the installation process. Further, providing a clamping force for sink 400 that acts between the underside of the rim and the basin floor of sink 400 may create a moment across the corresponding rim that may reduce warping of the rim and improve sealing of the rim to the support structure.

While mounting system 500 will be described in the context of an apron-front sink 400, mounting system 500 may be used with any self-rimming sink or any other type of sink that would benefit from such a mounting system. Referring to FIGS. 3-6, sink 400 is shown according to an exemplary embodiment. Sink 400 includes at least one receptacle for receiving and/or holding water (e.g., reservoir, washbasin, bowl, etc.), shown as basin 401. Basin 401 may have a variety of shapes, for example, circular, oval, polygonal, or sections of the shapes thereof (e.g. circular sector). According to the embodiment illustrated, basin 401 is substantially rectangular with a lateral width dimension (i.e., side-to-side) being greater than the depth dimension (i.e., front-to-back).

Basin 401 is shown as including a floor 410. As shown, floor 410 includes one or more sections which are each substantially planar. According to the various alternative embodiments, the sections of floor 410 may be non-planar, or the sidewalls of basin 401 may be continuously curved such that no discernable floor is formed. Floor 410 defines one or more apertures, shown as drain hole, that allow water to be removed from basin 401. The drain is configured to be coupled to a drain pipe and/or a garbage disposal mechanism, which is in turn coupled to a municipal sewerage system or to a septic system. Floor 410 is shown as being sloped towards the drain. For example, segments for floor 410 are each sloped towards the drain such that water in basin 401 may flow towards the drain by gravitational force.

Basin 401 is also shown as including one or more sidewalls (generically referred to as sidewall 420) which extend generally upwardly from floor 410. According to the embodiment illustrated, basin 401 includes a first through fourth sidewalls, shown as front sidewall 421 (e.g., the sidewall of the front portion), a left sidewall 422, a right sidewall 423, and a rear sidewall 424. Front sidewall 421 extends laterally across a front portion of basin 401, rear sidewall 424 extends laterally across a rear portion of basin 401, left sidewall 422 extends front-to-back between front sidewall 421 and rear sidewall 424 along a first side portion of basin 401 (i.e., a left side portion) and right sidewall 423 extends front-to-back between front sidewall 421 and rear sidewall 424 along a second side portion of basin 401 (i.e., a right side portion). According to the embodiment shown, sidewalls 420 are substantially vertical.

According to an exemplary embodiment, sidewalls 420 are coupled to floor 410 at substantially angled corners. According to an exemplary embodiment, the angle between sidewalls 420 and segments of floor 410 is between approximately 94 degrees and 99 degrees. According to the various alternative embodiments, the corners may be continuously curved or have discontinuously curved surface transitions from floor 410 to sidewall 420. Each of corners floor 410 to front sidewall 421, floor 410 to left sidewall 422, floor 410 to right sidewall 423, and floor 410 to rear sidewall 424 may have the same or different angle.

According to an exemplary embodiment, sidewalls 420 are coupled to each other at substantially right angles. According to the various alternative embodiments, the corners may be continuously curved or have discontinuously curved surface transitions from sidewall 420 to adjacent to sidewall 420. The angles for each of corners front sidewall 421 to left sidewall 422, left sidewall 422 to rear sidewall 424, rear sidewall 424 to right sidewall 423, and right sidewall 423 to front sidewall 421 may be the same or different.

Basin 401 is further shown as including one or more flanges or rims (generically referred to as rim 430) that at least partially define an outer and/or upper periphery of basin 401. Rim 430 is shown as being provided at a top portion of sidewall 420 and extending generally outwardly therefrom. According to an exemplary embodiment, rim 430 is configured to be exposed after installation and define the upper periphery of the sink. As a self-rimming sink, rim 430 is also configured to at least partially support sink 400 by resting on top of a countertop or any other suitable support surface such that an underside surface of rim 430 supports basin 401.

According to an exemplary embodiment, basin 401 includes a front rim 431, a left rim 432, a right rim 433, and a rear rim 434. Front rim 431 extends from a top portion of front sidewall 421, left rim 432 extends from a top portion of left sidewall 422, right rim 433 extends from a top portion of right sidewall 423, and rear rim 434 extends from a top portion of rear sidewall 424. The thickness of rim 430 may be the same or different than the thickness of sidewall 420. Further, the individual thicknesses of each of front rim 431, left rim 432, right rim 433, and rear rim 434 may be the same or different. According to the embodiment illustrated, front rim 431, left rim 432, right rim 433, and rear rim 434 have substantially the same thickness. According to the embodiment illustrated, left rim 432 and right rim 433 have a substantially similar width, rear rim 434 has a substantially greater width. According to an exemplary embodiment, rear rim 434 has a greater width so that it can define one or more openings configured to receive a fixture (e.g., faucet, sprayer, soap dispenser, water controls, etc.). According to the various alternative embodiments, the width dimension may be the same for each of front rim 431, left rim 432, right rim 433, and/or rear rim 434. Front rim 431, left rim 432, right rim 433, and rear rim 434 are shown to form a continuous rim surface. According to the various alternative embodiments, rim 430 may be formed of discontinuous rim segments.

According to an exemplary embodiment, each rim 430 is coupled to each adjacent sidewall 420 at substantially right angles. According to the various alternative embodiments, the corners may be continuously curved or provide discontinuously curved surface transitions from rim 430 to adjacent to sidewall 420. Each of the corners between front rim 431 to front sidewall 421, left rim 432 to left sidewall 422, right rim 433 to right sidewall 423, and rear rim 434 to rear sidewall 424 may have the same or different angles. Rim 430 defines a first plane (e.g., top plane), shown as rim plane 491. According to the embodiment illustrated, front rim 431, left rim 432, right rim 433 and rear rim 434 cooperate to define rim plane 491. According to an exemplary embodiment, rim plane 491 is a substantially horizontal plane.

Left rim 432 has a first edge, shown as left rim edge 436, and right rim 433 has a second edge, shown as right rim edge 438. Left rim edge 436 and/or right rim edge 438 may at least partially define a periphery of basin 401. According to an exemplary embodiment, the distance from left rim edge 436 to right rim edge 438 is approximately 36 inches, and the distance from left sidewall 422 to right sidewall 423 is approximately 32.5 inches. According to another exemplary embodiment, left rim edge 436 and right rim edge 438 are approximately 33 inches apart for a reservoir that has a width of approximately 29.5 inches. According to the embodiment illustrated, left rim edge 336 and right rim edge 338 are approximately 30 inches apart for a reservoir that has a width of approximately 26.5 inches. According to the various exemplary embodiments, the rim may be sized to be greater or less than the dimensions provided above.

Sink 400 also includes an apron 440 that extends laterally across a front portion of sink 400 to define a front portion of the sink that is configured to be visible to a user when installed. As shown, apron 440 is coupled to basin 401 and is supported at a substantially vertical orientation. According to an exemplary embodiment, apron 440 includes a first surface (e.g., structure, member, etc.), shown as top flange 441, a second surface (e.g., structure, member, etc.) shown as front face 442, a first end surface, shown as left end portion 451, and a second end surface, shown as right end portion 461. Left end portion 451 is shown as being located laterally opposite of right end portion 461.

Top flange 441 extends outwardly in a forward direction from a top portion of front sidewall 421 and front rim 431. A top surface of apron 440 may be substantially defined by top flange 441, front rim 431, or any combination thereof. According to the embodiment illustrated, the transition from top flange 441 to front rim 431 is substantially continuous. Similarly, the transition from top flange 441 to left rim 432, and the transition from top flange 441 to right rim 433, is also substantially continuous. According to an exemplary embodiment, front face 442 extends generally downwardly from top flange 441 in a vertical direction.

Top flange 441 is shown to extend laterally to left end portion 451 and to right end portion 461. Left end portion 451 and right end portion 461 may form extension or wing portions that are configured to at least partially overlap or cover a portion of the cabinetry or other structure upon which the sink is supported. Left end portion 451 includes an end surface, shown as left end surface 453 that extends generally rearwardly and substantially perpendicular to front face 442. Left end portion 451 also includes rear edge 455 that forms a rearward extremity of left end portion 451 and/or left end surface 453. Left end portion 451 further includes a front edge 457 that forms a lateral extremity of apron 440. According to the exemplary embodiment, left end surface 453 is recessed laterally from front edge 457. In other words, front edge 457 extends in a lateral direction beyond the left end surface 453.

Similarly, right end portion 461 includes an end surface, shown as right end surface 463 that extends generally rearwardly and substantially perpendicular to front face 442. Right end portion 461 also includes rear edge 465 that forms a rearward extremity of left end portion 461 and/or right end surface 463. Right end portion 461 further includes a front edge 467 that forms a lateral extremity of apron 440. According to the exemplary embodiment, right end surface 463 is recessed laterally from front edge 467. In other words, front edge 467 extends in a lateral direction beyond the left end surface 453.

Figure 4:
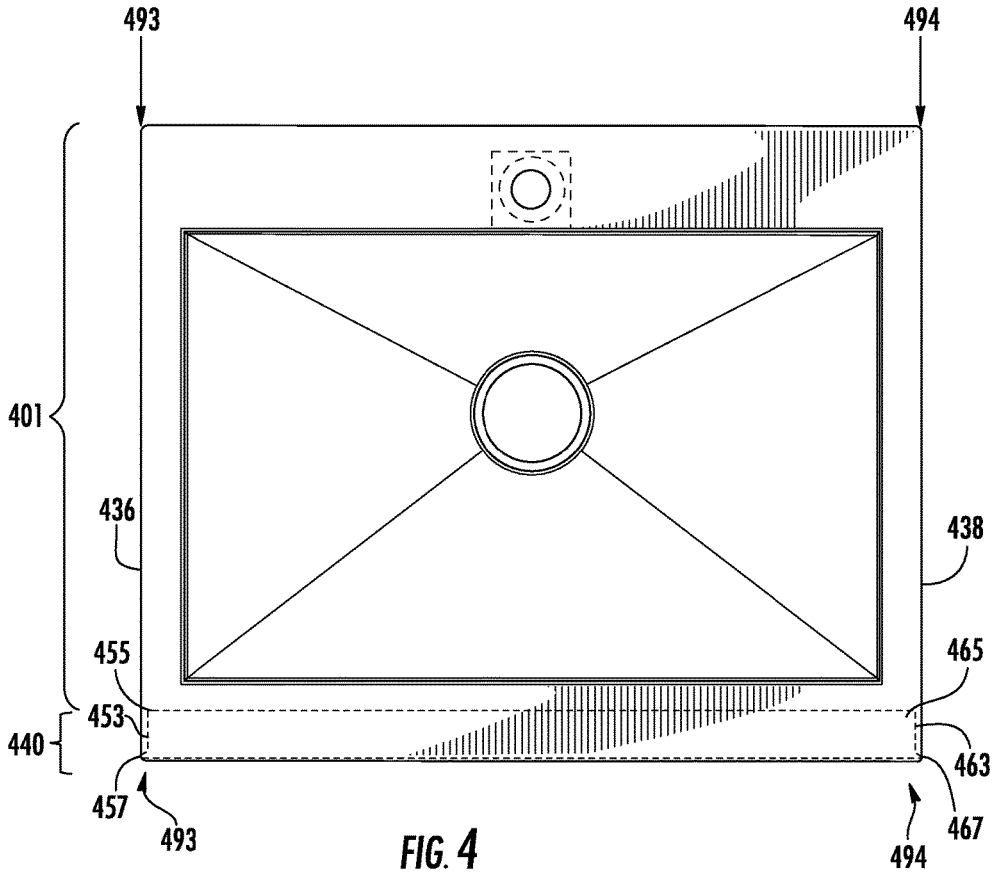
FIG. 4 is a top plan view of the self-rimming sink of FIG. 3.

Referring to FIG. 4, a top view of sink 400 is shown according to an exemplary embodiment. According to the embodiment illustrated, apron 440 extends laterally between left rim edge 436 and to right rim edge 438. However, only between front edge 457 and front edge 467 does apron 440 extend the entire distance between left rim edge 436 and to right rim edge 438. The lateral distance from left end surface 453 to right end surface 463 is less than the lateral distance from left rim edge 436 and to right rim edge 438. In such an embodiment, left end surface 453 and right end surface 463 are inwardly offset or recessed relative to left rim edge 436 and to right rim edge 438 respectively. During installation, left end surface 453 and right end surface 463 are configured to be received within the opening that has been cutout in a countertop to receive sink 400. By having front edge 457 and front edge 467 extend laterally beyond left end surface 453 and right end surface 463 respectively, front edge 457 and front edge 467 can conceal or otherwise hide a cutting line made in the countertop and/or cabinetry that is necessary to receive sink 401.

Figure 5:
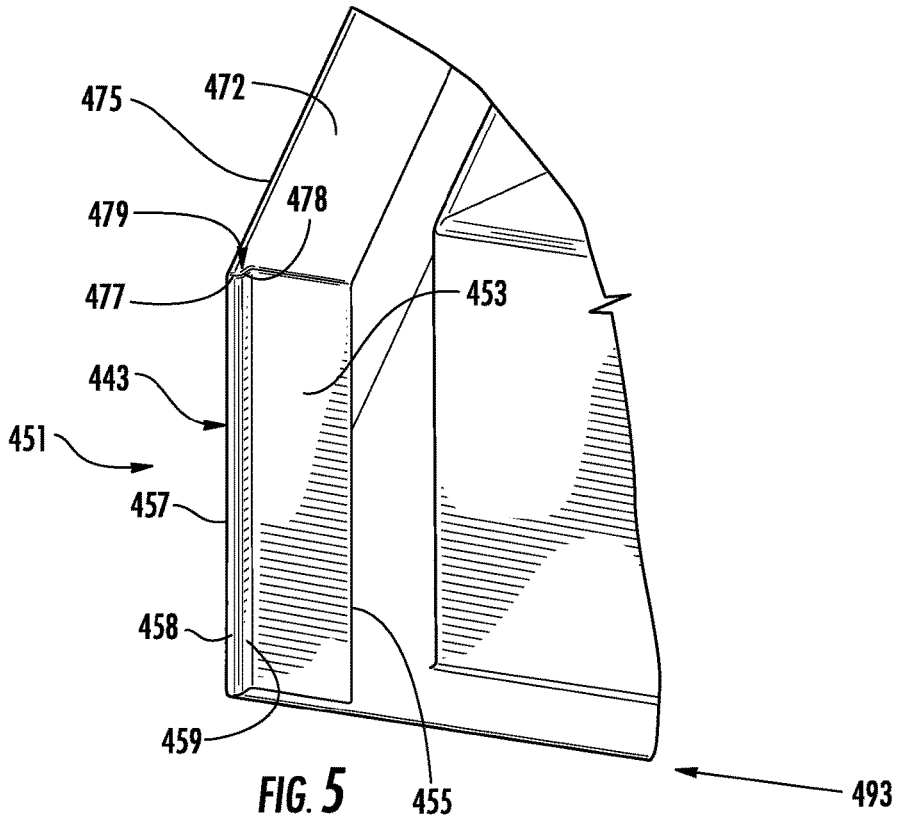
FIG. 5 is a partial bottom prospective view of the self-rimming sink of FIG. 3.

Referring to FIG. 5, an enlarged view of left end portion 451 is shown according to an exemplary embodiment. The description of left end portion 451 may be transferred to right end portion 461. Front edge 457 is a raised edge or lip formed by a projection extending from left end surface 453 or by any other structure. According to the embodiment illustrated, front edge 457 is formed by bending or otherwise shaping the sheet material (e.g., stainless steel, etc.) used to define left end portion 451. After shaping the sheet material, left end portion 451 is left with multiple surfaces. Specifically, left end portion 451 is shown as including left end surface 453, a first transition surface 458 and a second transition surface 459. First transition surface 458 and second transition surface 459 are shown to be substantially vertical and extending the entire height of the apron. First transition surface 458 extends rearwardly from front face 442 and is substantially perpendicular to front face 442. As shown, first transition surface 458 is substantially coplanar with left rim edge 436 (which defines a left side plane 493). According to the various alternative embodiments, first transition surface 458 may be rounded and tangential to left side plane 493. As shown, second transition surface 459 extends inward between first transition surface 458 and left end surface 453 at an angle of approximately 30 degrees relative to front face 442. According to the various alternative embodiments, second transition surface 459 can extend inward at an angle that is sufficient to recess left end surface 453 relative to the lateral front edge of the apron.

Figure 6:
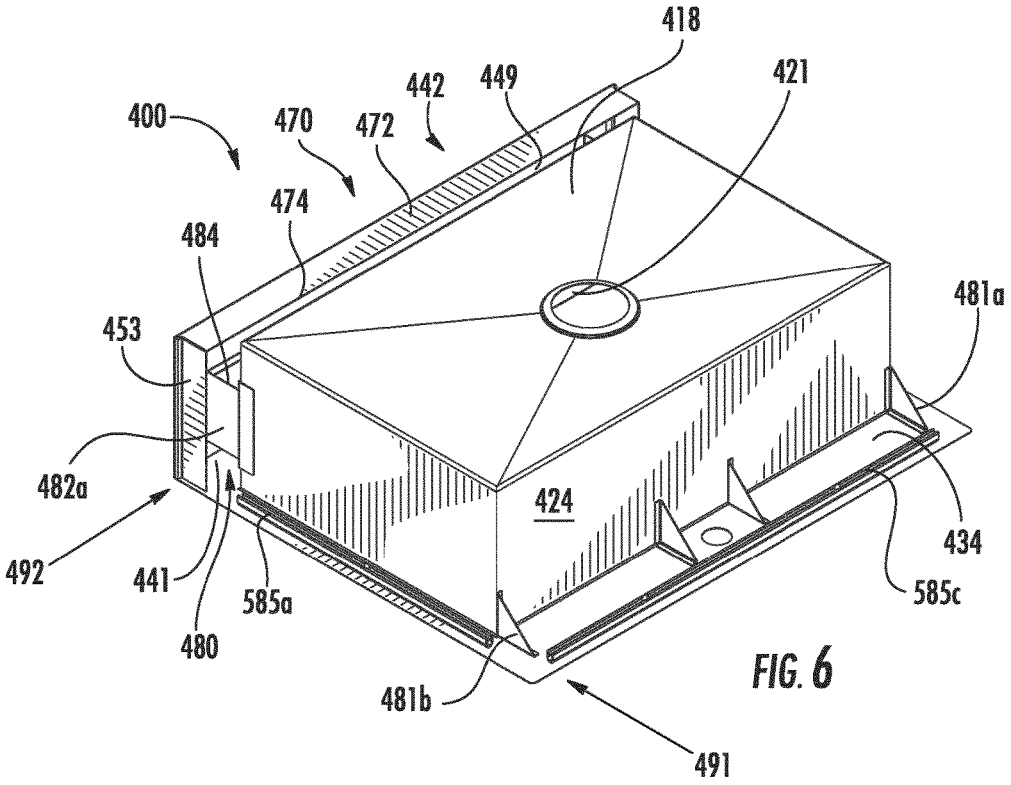
FIG. 6 is a bottom perspective view of the self-rimming sink of FIG. 3.

Referring to FIG. 6, a bottom perspective view of sink 400 is shown according to an exemplary embodiment. Apron 440 is shown as including a third end portion, shown as bottom end portion 470. Bottom end portion 470 includes a third end surface, shown as bottom end surface 472. Bottom end surface 472 extends generally rearwardly from front face 442. According to the embodiment illustrated, bottom end portion 470 has a rear edge 474 that forms a bottom extremity of apron 440. According to an exemplary embodiment, rear edge 474 is coplanar with rear apron plane 492.

According to an exemplary embodiment, bottom end surface 472 couples each of front face 442, left end surface 453, and right end surface 463 at substantially right angles. According to the various alternative embodiments, the corners may be continuously curved or provide discontinuously curved surface transitions from the bottom end surface to the adjacent surfaces. Each of corners bottom end surface 472 to front face 442, bottom end surface 472 to left end surface 453, and bottom end surface 472 to right end surface 463 may be the same or different angles.

Referring to back to FIG. 5, front face 442 is shown as including a first bottom edge 475, while first transition surface 458 is shown as including a second bottom edge 477 and second transition surface is shown as including a third bottom edge 478. First bottom edge 475, second bottom edge 477, and third bottom edge 478, define an area 479 that is configured to receive a portion of bottom end surface 472.

The height of apron 440 may vary depending on the application. For example, sink 400 may include a full apron or a short apron. According to the embodiment illustrated, apron 440 is a relatively short apron having a height between approximately 6 and 7 inches. The height is being defined as the distance between top flange 441 and bottom end surface 472 of apron 440. According to the various alternative embodiments, sink 400 may include a full apron, which descends between 8 inches and 9 inches from rim plane 491.

Sink 400 may include a second plane, shown as rear apron plane 492, defined by left end 455 and right end 465. According to an exemplary embodiment, rear apron plane 492 is defined by left end 455, right end 465, and bottom end 474. Rear apron plane 492 is substantially vertical and is substantially perpendicular to left side plane 493, to right side plane 494, and to rim plane 491. Rear apron plane 492 is also substantially parallel to front face 442, front surface 443, and front sidewall 421. Rear apron plane 492 is be configured to abut a front surface of a cabinet when sink 400 is in an installed position. Rear apron plane 492 is configured to be substantially flush to a front surface of a cabinet when sink 400 is in an installed position. Having a substantially vertical rear apron plane provides a substantially flat backside to the apron. As such, when sink 400 is installed, the apron may fit flush against the front of the cabinet instead of dropping into a cut or an opening. This saves the installer iterative cutting and fitting, which requires repeated lifting of a heavy sink Apron 440 may define a cavity (e.g., recess, depression, carve-out, hollow, etc.), shown as cavity 480 in FIG. 6. According to one embodiment, top flange 441, front face 442, left end portion 451, and right end portion 461 at least partially define cavity 480. According to the embodiment shown, cavity 480 is further defined by bottom end portion 470. Cavity 480 may extend substantially between bottom end portion 470 and top flange 441. Cavity 480 may extend substantially between top flange 441 and bottom end surface 472. According to an exemplary embodiment, apron 440 has a cross sectional shape that is substantially C-shaped in a vertical direction, with the opening of the "C" facing rearwardly towards basin 401.

Apron 440 is also shown as including a structure (e.g., member, reinforcement, etc.), shown as beam 484. Beam 484 is shown disposed to extend laterally across rear surface 449. Beam 484 may be coupled to rear surface 449 in a variety of methods. According to an exemplary embodiment, beam 484 is coupled to rear surface 449 with an adhesive.

According to an exemplary embodiment, bottom end portion 470, bottom end surface 472, and bottom end 474 are offset from front sidewall 421. According to the embodiment illustrated, no supports (e.g. structures, members, brace, spars, flanges, webs, etc.) extend from a bottom portion of front sidewall 421 to apron 440 or from front sidewall 421 to bottom end portion 470 or from front sidewall 421 to bottom end surface 472 or from front sidewall 421 to bottom end 474. Disconnecting the bottom of apron 440 from front sidewall 421 enables a portion the cabinet to fit between the apron and the basin. This enables apron 440 to be installed flush to a front face of the cabinet. Further this requires less precise cutting by an installer because the cut edges of the cabinet will be hidden from view.

Sink 400 may include one or more supports (e.g. structures, members, spars, flanges, webs, etc.) which extend from a middle portion of basin 401 to apron 440. According to an exemplary embodiment, sink 400 includes a first support, shown as left support 482*a*, and a second support, shown as right support 482*b*, which are substantially similar to supports 382.

Sink 400 may include one or more braces 481 (e.g., supports, structures, members, brace, spars, flanges, webs, etc.). According to the embodiment illustrated, sink 400 includes four braces 481. Brace 481 may include a first side coupled to rear sidewall 424 and a second side coupled to rim 430. For example, brace 481 includes a first side coupled to an outer surface of rear sidewall 424 and a second side coupled to an underside of rear rim 434. According to an exemplary embodiment, brace 481 is configured to support rear rim 434 perpendicularly to rear sidewall 424 and to reduce deflection of rim 430. As shown, brace 481 is substantially triangular, but according to various alternate embodiments may have a variety of shapes.

Sink 400 may be formed of any suitably rigid material. Basin 401 and apron 440 may be the same or different materials. Basin 401 and apron 440 may be one piece or may be constructed of several pieces coupled together (e.g., welded, stir-welded, soldered, sweated, fastened, etc.). Basin 401 and apron 440 may be formed by any suitable means (e.g., stamping, casting, forging, bending, hammering, etc.). According to one embodiment, sink 400 may be made of stainless steel. According to the exemplary embodiment, sink 400 is a single piece of 18 gauge, T-304 stainless steel.

Still referring to FIG. 4, channel 585 of mounting system 500 is shown as being coupled to sink 400. Channel 585 functions as a receiving structure for the other components of mounting system 500, and in doing so, at least partially establishes the clamping location or locations of mounting system 500 around sink 400. Referring back to FIGS. 1 and 2, channel 585 is formed so as to have a downwardly facing opening or cavity 589 for receiving the other components of mounting system 500. According to an exemplary embodiment, channel 585 has a substantially inverted U-shaped cross section defined by a top flange 586 and opposing side flanges 587, which descend downwardly from top flange 586. Top flange 586 and side flanges 587 cooperate to define cavity 589. The free ends of side flanges 587 provide a support structure, shown as a ledge. According to the embodiment illustrated, the ledge is formed by bending the free ends of side flanges 587 inward and upward. By manipulating the free ends in such a manner, the distance between opposing bottom flanges 588, in the area between the upwardly extending portions, is narrower than the distance between opposing side flanges 587. In such a configuration, the free ends of bottom flanges 588 form a ledge or support surface for first fastener 504, while the cross sectional shape of channel 585 as a whole helps resist a downward force applied to first fastener 504 by the other components of mounting system 500.

Channel 585 is not limited to a U-shaped cross section, and according to the various alternative embodiments, channel 585 may take the form of any cross sectional shape that is suitable for supporting first fastener 504 and/or resisting a downward force applied to first fastener 504 by the other components of mounting system 500. For example, channel 585 may have a cross sectional shape that is substantially C-shaped, V-shaped, I-shaped, L-shaped, T-shaped, etc. Further, channel 585 may be substantially solid member having one or more apertures or other receiving structures for receiving the other components of mounting system 500 (e.g., first fastener 504, linking member 502, etc.).

Channel 585 is intended to be fixedly coupled to an underside of sink 400. According to an exemplary embodiment, channel 585 is configured to be fixedly coupled to an underside of sink 400 at a location that is near or adjacent an intersection of rim structure 430 and a side wall of basin 401. According to the embodiment illustrated, channel 585 is positioned such that top flange 586 engages an underside of rim structure 430 and there is little to no clearance between one of the opposing side flanges 587 and a sidewall 422 of basin 401. Such positioning may be particularly useful in eliminating gaps between a countertop 290 of support structure 200 and rim structure 430, pulling a warped rim structure 430 flat, and/or pulling rim structure 430 tight to a non-flat countertop, while still allowing for sufficient clearance between mounting system 500 and support structure 200. According to the various alternative embodiments, channel 585 may be supported in other locations, for example, by being spaced away from a sidewall of basin 401.

According to an exemplary embodiment, the coupling of channel 585 to sink 400 takes place along top flange 586. According to the embodiment illustrated, channel 585 is coupled to sink 400 by welding top flange 586 to an underside of rim structure 430. According to the various alternative embodiments, channel 585 may be coupled to sink 400 coupled using one or more fasteners, an adhesive or any other suitable coupling technique applied to top flange 586 and/or any other portion of channel 585 (e.g., an opposing side flange 587 that may be near a sidewall of basin 401, etc.). The coupling of channel 585 to sink 400 may be performed by a manufacturer of sink 400, such that sink 400 will include channel 585 when purchased, or alternatively, may be performed by a subsequent installer of sink 400 if sink 400 does not already have channel 585 installed thereon.

The number of channels 585 coupled to sink 400 may vary depending on a number of factors including, but not limited to, the size of channel 585, the size of sink 400, the availability of space around sink 400 to receive channel 585 and the clamping force needed to secure sink 400 to support structure 200. According to an exemplary embodiment, channel 585 is an elongated member having a length that is sufficient for receiving one or more first fasteners 504. For example, channel 585 may be configured to receive a plurality of first fasteners 504 in a spaced apart manner. Configuring channel 585 to receive more than one first fastener 504 may allow for a reduced number of channels 585. For example, in certain applications, it may only be necessary to provide a single channel 585 on each side of sink 400 that is to serve as a clamping location, even though more than first fastener 504 may be provided along such a side.

Referring back to FIG. 6, three channels 585 are shown as being used with sink 400. A first channel 585*a* is shown as being coupled along a left side of sink 400, a second channel 585*b*, while hidden from view, is coupled along a right side of sink 400, and a third channel 585*c* is shown as being coupled along a rear portion of sink 400. First channel 585*a* and second channel 585*b* are shown as having a length extending in a front-to-back direction that is substantially the same as the depth of basin 401. Third channel 585*c* is shown as having a length extending in a side-to-side direction that is substantially the same as the width of basin 401.

According to the various alternative embodiments, channel 585 may be sized to receive only a single or an otherwise small number of first fasteners 504. In such an embodiment, more than one channel 585 may be provided along a side of sink 400.

Figure 9:
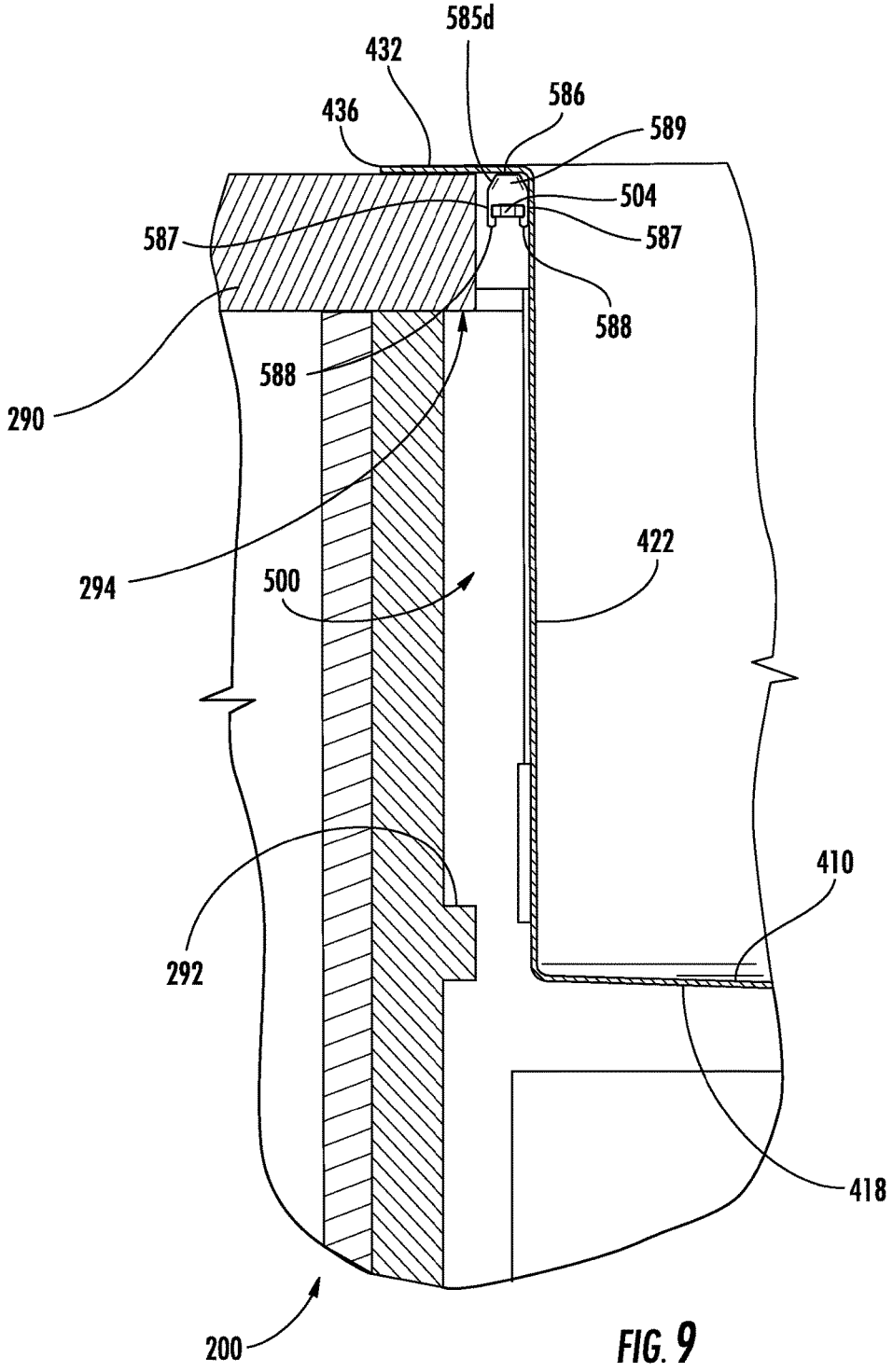
FIG. 9 is a cross sectional view of the sink assembly showing only a portion of a mounting system.
Figure 10:
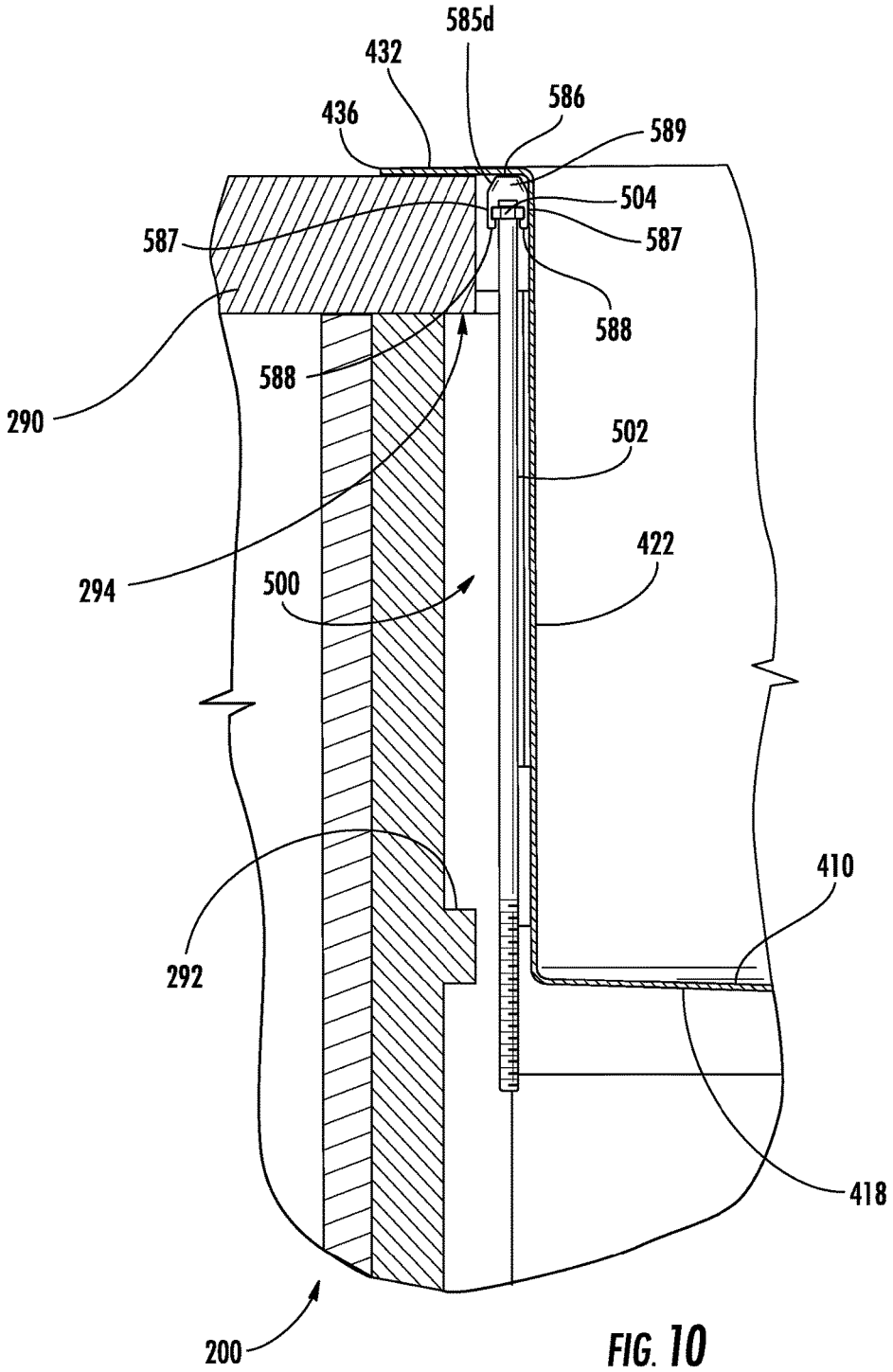
FIG. 10 is another cross sectional view of the sink assembly showing only a portion of a mounting system.

Referring to FIGS. 9 and 10, channel 585 defines a cavity 589 configured to receive first fastener 504. First fastener 504 includes a first portion that is configured to be supported by or otherwise coupled to channel 585 and a second portion that is configured to receive or otherwise be secured to an end of linking member 502. According to an exemplary embodiment, first fastener 504 is a nut having internal threads that are configured to receive a threaded end of linking member 502. The nut has an outer dimension that is greater than the distance between the upwardly extending portions of opposing bottom flanges 588 such that the nut overlaps and is supported on a ledge that is formed by the free ends of opposing side flanges 587.

According to an exemplary embodiment, first fastener 504 is fixedly coupled to channel 585 such that first fastener 504 cannot be readily removed from channel 585. For example, first fastener 504 may be fixedly coupled in a predetermined position along the length of channel 585, or may be fixedly coupled to channel 585 in a manner that allows first fastener 504 to be selectively move along channel (e.g., by capturing first fastener 504 in a slot that fixedly couples first fastener 504 to channel but allows first fastener 504 to slide along the length of channel 585, etc.). For the embodiment in which first fastener 504 may be fixedly coupled in a predetermined position along the length of channel 585, first fastener 504 may be welded to opposing bottom flanges 588 of channel 585. According to an alternative embodiment, first fastener 504 may be integrally formed with channel 585 such that a separate fastener does not need to be provided. For example, channel 585 may itself define one or more threaded apertures or any other receiving structure that is configured to receive the end of linking member 502. Having first fastener 504 be fixedly coupled to and/or integrally formed with channel 585 may simplify the installation process by reducing the number of components that an installer needs to manage while installing sink 400. In such embodiments, linking member 502 will preferably be removably coupled to first fastener 504, but alternatively could be fixedly coupled to first fastener 504 such that linking member 502 is also fixedly coupled to and/or integrally formed with channel 585.

According to another exemplary embodiment, first fastener 504 may be a separate component that is configured to be placed in channel 585 by the installer. In such an embodiment, first fastener 504 may be placed in channel 585 before or after linking member 502 is secured to first fastener. According to a first exemplary embodiment, first fastener 504 may be placed in channel 585 by being inserted through an opening along a lateral end of channel 585 above the ledge formed by the free ends of opposing side flanges 587. According to a second exemplary embodiment, first fastener 504 may be placed in channel 585 by being inserted upwards through the opening defined by the upwardly extending portions of opposing bottom flanges 588. In such an embodiment, the orientation of first fastener 504 may be manipulated by the installer (e.g., turned, etc.) so that first fastener 504 can fit through the opening defined by the upwardly extending portions of opposing bottom flanges 588 without requiring the opening to be expanded. Alternatively, channel 585, particularly side flanges 587, may be configured to flex outwardly as first fastener 504 is being inserted through the opening defined by the upwardly extending portions of opposing bottom flanges 588, and then return to its original shape after first fastener 504 is through the opening so that first fastener 504 can be captured by the ledge formed by the free ends of opposing side flanges 587.

For the exemplary embodiment in which first fastener 504 is a separate component that is configured to be placed in channel 585 by the installer, first fastener 504 may be configured to be secured in a fixed position relative to channel 585 or may be configured to be movably received within channel 585 such that the mounting position relative to channel 585 can be selectively adjusted by the installer. For example, before mounting assembly is clamped down, first fastener 504 may be configured to slide along the ledge formed by the free ends of opposing side flanges 587.

Coupled to first fastener 504 is linking member 502. Linking member 502 has a first end and an opposite second end. The first end of linking member 502 is received by first fastener 504, while the second end of linking member 502 is received by bracket 583 and second fastener 506. Linking member 502 is shown as being in the form of an elongated, straight rod having a substantially circular cross section that extends continuously between the first end and the second end. According to the various alternative embodiments, linking member 502 may take the form of any suitable member capable of transferring a force being applied by second fastener 506 to first fastener 504 for creating a clamping force. For example, linking member 502 may be a rod or tubular member having any of a variety of cross sectional shapes or may be a cable, bar, braided wire, etc.

According to an exemplary embodiment, linking member 502 has external threads at both its first end and its second end. While the entire length of linking member 502 may be threaded, linking member 502 is shown as only having its first and second ends threaded with a central portion of linking member 502 is unthreaded. According to the various alternative embodiments, one or more of the threaded sections may be eliminated and/or replaced with an attachment structure that corresponds to the type of fastener being used. For example, one or more of the threaded sections may be replaced with one or more ribs or barbs if a clip is being used as the fastener rather than a threaded nut. When sink 400 is being installed, linking member 502 is configured to extend generally vertically between channel 585 and bracket 583. According to the embodiment illustrated, the second end of linking member 502 extends below bottom surface 418 of floor 410 of basin 401. As described above, the first end of linking member 502 is shown as including first fastener 504. First fastener 504 may be formed as part of linking member 502, threadably engaged to linking member 502, welded to linking member 502, or otherwise coupled to linking member 502.

Received by the second end of linking member 502 is bracket 583. Bracket 583 is configured to span a gap between support structure 200 and a side of sink 400. According to an exemplary embodiment, bracket 583 includes a first portion (e.g., end, leg, cabinet portion, cleat portion, etc.), shown as outer portion 510, a second portion (e.g., end, leg, sink portion, basin portion, etc.), shown as inner portion 512, and a third portion, shown as central portion 514. According to the embodiment illustrated, outer portion 510 and inner portion 512 extend generally upwardly and outwardly from a relatively flat middle portion 514 to give bracket 583 a substantially U-shape.

Middle portion 514 defines the portion of bracket 583 configured to receive second fastener 506 and comprises one or more apertures (e.g., slot, eyelet, notch, etc.), shown as an opening 516. Opening 516 is configured to receive linking member 502. Opening 516 may or may not be centered in middle portion 514. According to the exemplary embodiment, opening 516 is a laterally oriented slot. The laterally oriented slot allows linking member 502 to subsist in a substantially vertical orientation while clamping sink 400 to support structure 200. Outer portion 510 and inner portion 512 may be configured to be received into receiving locations disposed on cabinet 200 and sink 400, respectively. While outer portion 510 and inner portion 512 are shown as having substantially the same height, outer portion 510 and inner portion 512 may have different heights to compensate for a difference in height between floor 410 and cleat 292. For example, outer portion 510 may be taller than inner portion 512, or vice versa.

Bracket 583 may be formed in any suitable manner (e.g., stamped, forged, bent, pressed, cast, etc.). Bracket 583 may be formed from a suitably rigid material (e.g., metal, plastic, etc.). According to an exemplary embodiment, bracket 583 is stamped from a piece of sheet metal. According to the various alternative embodiments, bracket 583 may be substantially flat, may be continuously curved, or may have any suitable shape. Middle portion 514 may be configured to compensate for a difference in height between floor 410 and cleat 292 or countertop 290 (e.g., include a step, include a structure, include one or more bends, etc.). Bracket 583 may have any suitable thickness.

Figure 12:
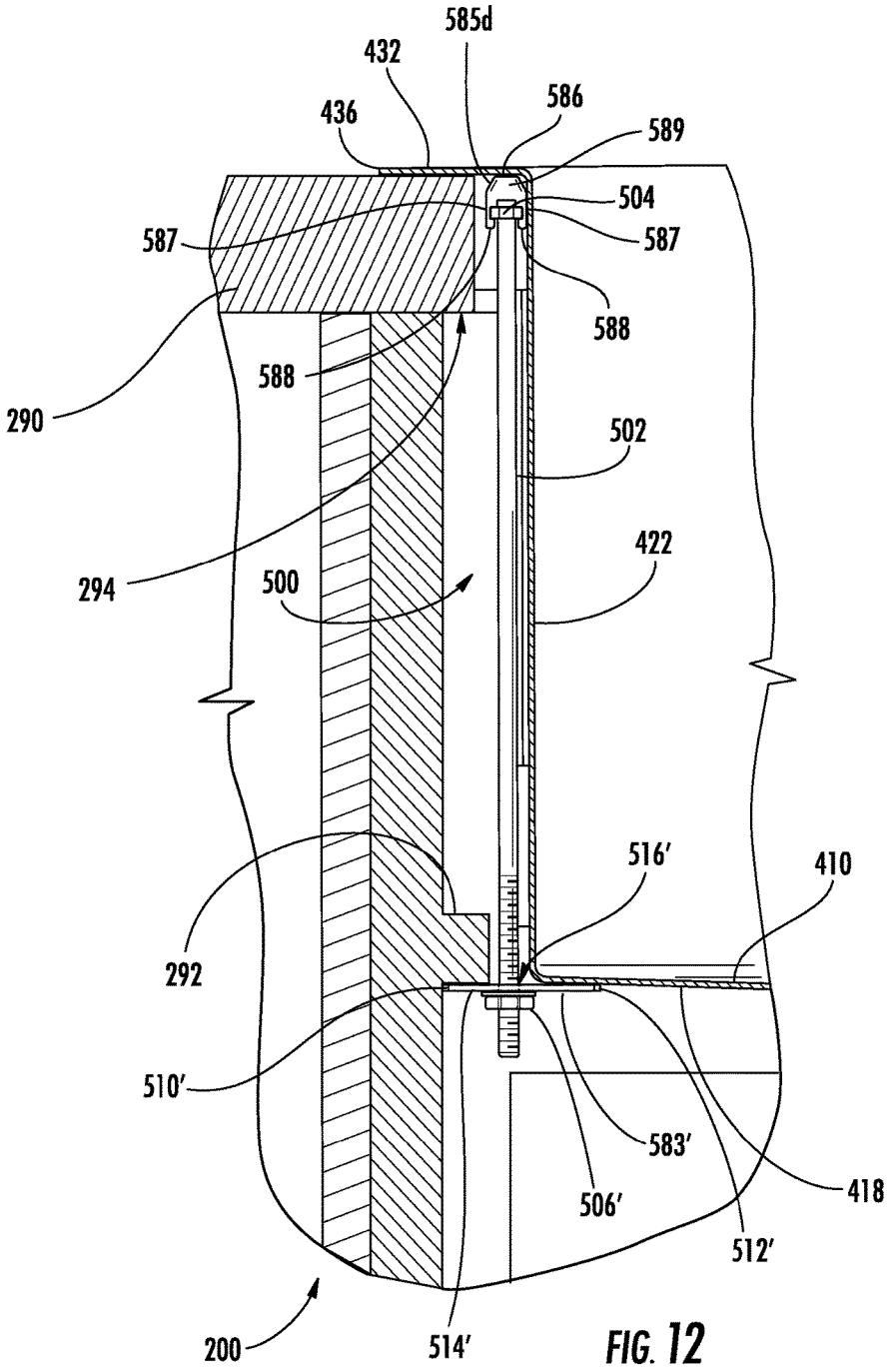
FIG. 12 is a cross sectional view of a sink assembly showing a mounting system according to another exemplary embodiment.

Referring to FIG. 12, the bracket, shown as a bracket 583', is shown according to another exemplary embodiment. According to the embodiment illustrated, outer portion 510', middle potion 514', and inner portion 512' form a continuous, substantially flat, bracket 583'. Inner portion 512' has a greater surface contact area with bottom surface 418 of sink 400 than does inner portion 512. The greater contact area may reduce or eliminate the point load applied by inner portion 512, thus reducing the stress applied from inner portion 512' to floor 410. Reducing localized stresses may reduce the likelihood of damage to sink 400. According to a further exemplary embodiment, bracket 583' may be contoured to match the angle of floor 410 relative to vertical, thereby further increasing contacting surface area between bracket 583' and sink 400

Referring back to FIG. 1, bracket 583 is configured to bridge the gap between sink 400 and support structure 200. According to an exemplary embodiment, bracket 583 is configured to extend between sink 400 and a projection (e.g., stop, ledge, etc.) on support structure 200, shown as cleat 292. Cleat 292 may be formed as part of the base cabinet or coupled to the base cabinet during installation of sink 400. For example, cleat 292 may be a strip of wood added to the inside of the base cabinet during installation. As shown, cleat 292 is positioned so that bracket 583 is substantially horizontal when tightened down (e.g., cleat 292 is positioned such that a bottom surface of cleat 292 is substantially coplanar with a bottom surface of floor 410 of basin 401, etc.). However, bracket 583 does not have to be horizontal and, in certain applications, may be provided at an angle relative to horizontal to compensate for the difference in relative heights of floor 410 and cleat 292.

Coupled to the second end of linking member 502 is second fastener 506. Second fastener 506 is configured to retain bracket 583 on linking member 502 and force bracket 583 upwards against sink 400 and cleat 292 of support structure 200. According to an exemplary embodiment, second fastener 506 is a nut having internal threads that correspond to the external threads of the second end of linking member 502. In such an embodiment, second fastener 506 threadably engages the second end of linking member 502 to retain bracket 583 on linking member 502 and force bracket 583 upwards against sink 400 and support structure 200 when tightened. According to the embodiment illustrated, second fastener 506 is a wing nut having outwardly extending wings or projections that may be easily grasped by the installer (either by hand or with a tool) for tightening mounting system 500. According to the various alternative embodiments, any suitable securing mechanism may be used in place of the wing nut. According to the embodiment illustrated, a locking device, shown as a lock washer 518, is located between second fastener 506 and bracket 583 to help maintain the clamping force being applied by mounting system 500 once it has been established.

Figure 7:
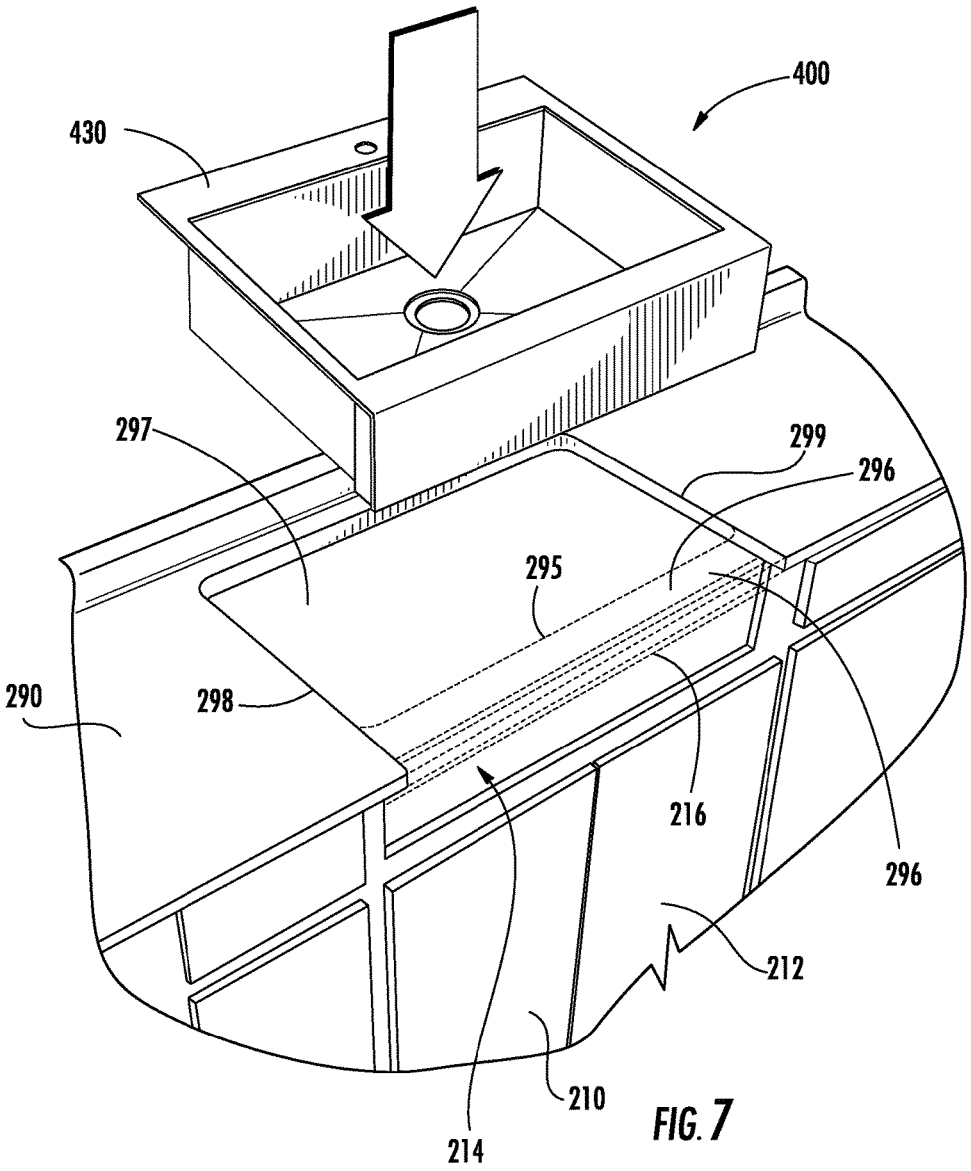
FIG. 7 is a top perspective view of the self-rimming sink of FIG. 3 being installed onto a support structure according to an exemplary embodiment.
Figure 8:
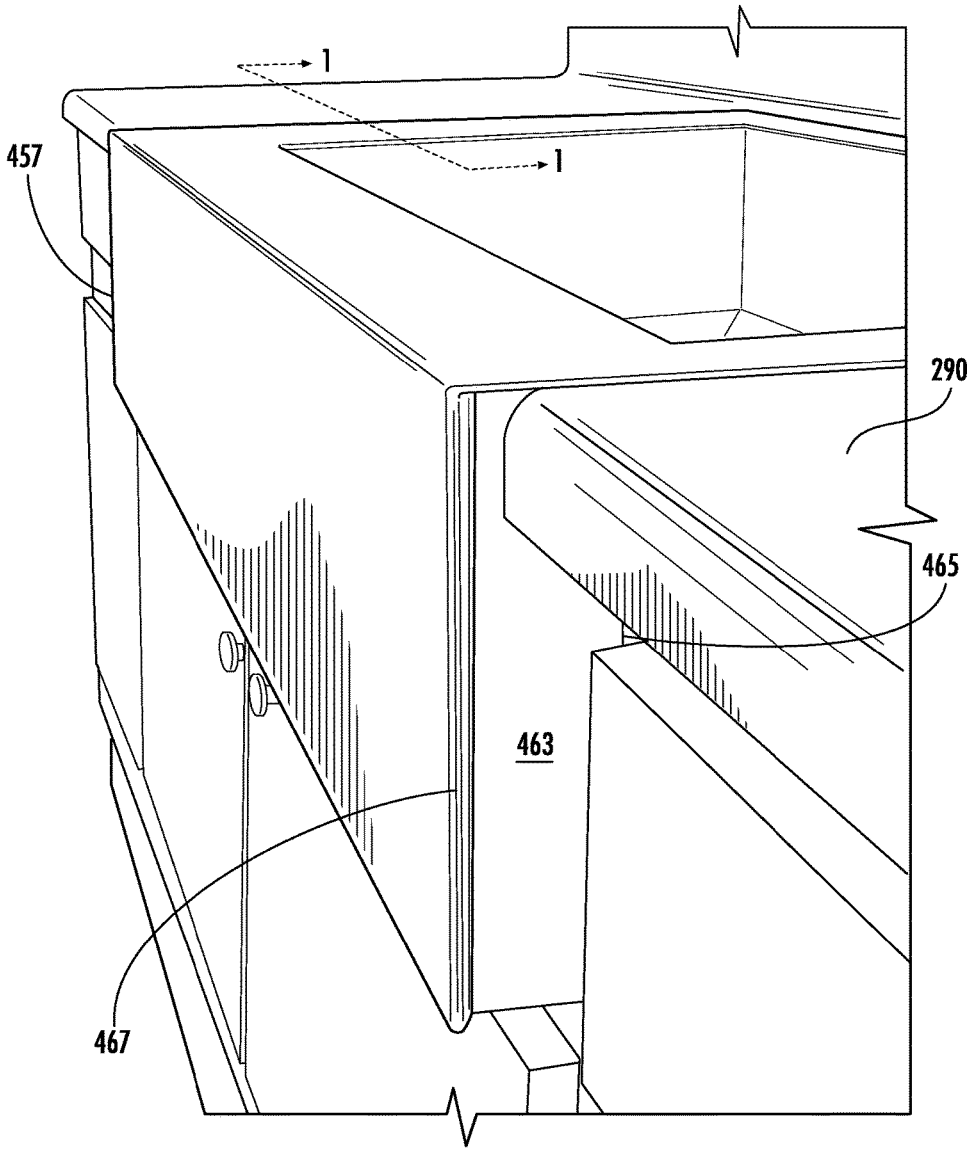
FIG. 8 is a top perspective view of the self-rimming sink of FIG. 3 supported by the support structure of FIG. 7.
Figure 11:
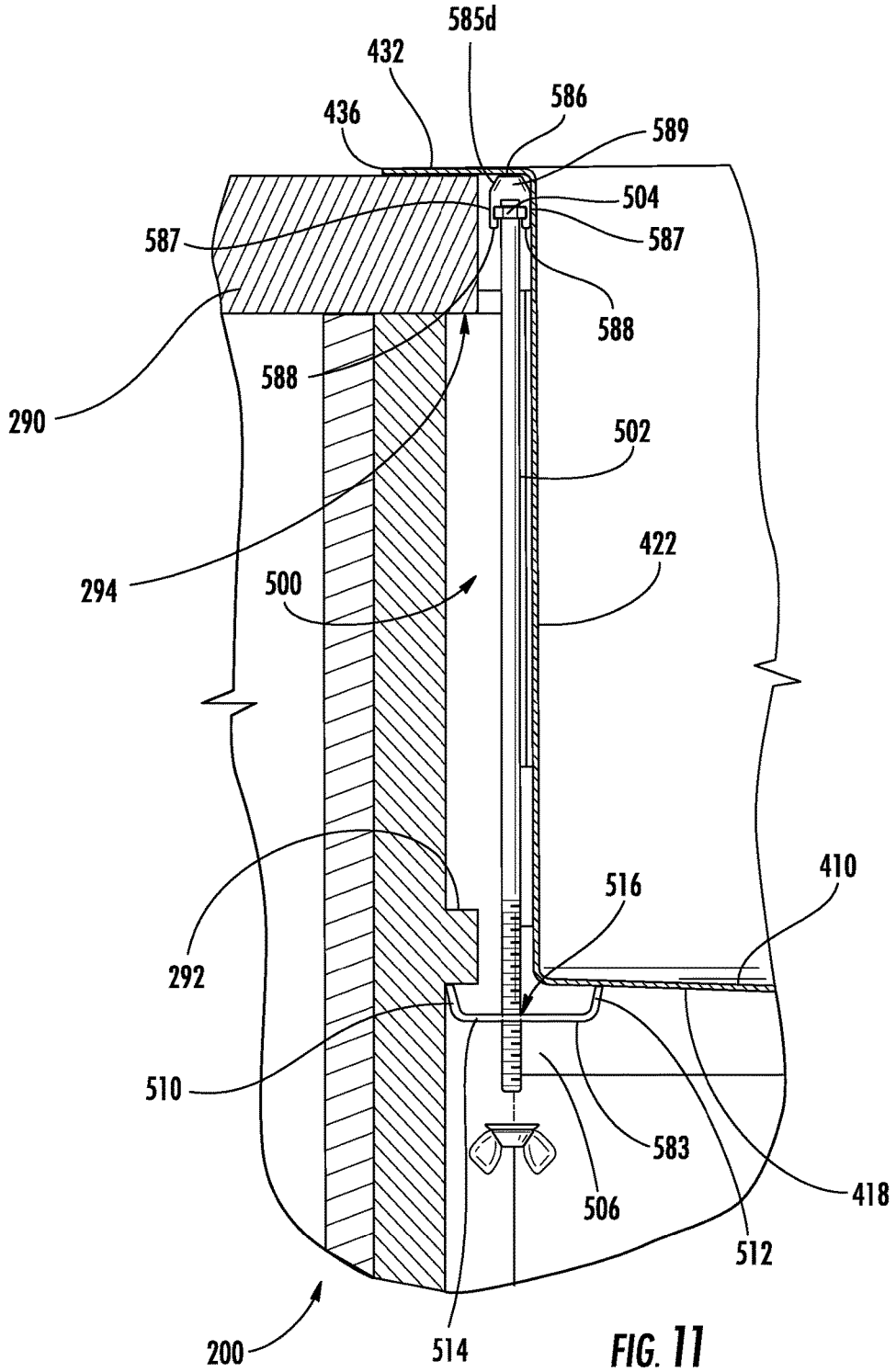
FIG. 11 is a further cross sectional view of the sink assembly.

Referring to FIGS. 7 and 8, sink 400 is configured to be installed into a support structure that includes a base cabinet and countertop 290. Referring to FIGS. 9-11, with sink 400 in place, linking member 502, if not already coupled to channel 585, is inserted into channel 585. As detailed above, linking member 502 can be inserted into channel 585 differently depending on whether first connector 504 gets coupled to linking member 502 before or after linking member 502 is inserted into channel 585. For exemplary purposes only, first connector 504 is shown in FIG. 9 as being separate from linking member 502 and coupled to channel 585. In such an embodiment, the first end of linking member 502 would get coupled to first fastener 504 to retains linking member 502 in channel 585.

With linking member 502 inserted into channel 585, bracket 583 is placed over the lower end of linking member 502 and moved upwards until bracket 583 bridges a gap between bottom surface 418 of basin floor 410 and a cleat 292 of the base cabinet, as shown in FIG. 11. With bracket 583 in place, second fastener 506 is coupled to the second end of linking member 502 and is subsequently tightened. Second fastener 506 is tightened until second fastener 506 engages a bottom surface of bracket 583 and bracket 583 engages cleat 292 and bottom surface 418 of basin floor 410. When bracket 583 contacts both bottom surface 418 of basin floor 410 and cleat 292, a reactionary force is created pushing downwardly on second fastener 506. According to an exemplary embodiment, second fastener 506 in turn applies downward force to linking member 502, which transfers the downward force to channel 585, which in turn, pulls down on rim 430. Continued tightening of second fastener 506 clamps sink 400 to the base cabinet and countertop 290. According to the embodiment illustrated, bracket 583 applies a reactionary upward force on bottom surface 418 of floor 410. The upward force on bottom surface 418 of floor 410 creates a moment across left rim 432 which applies a downward force to left rim edge 436. The downward force on left rim edge 436 reduces warping of rim 430 and improves sealing of rim 430 to countertop 290. The downward force on left rim edge 436 may improve sealing sufficiently to reduce or eliminate the need for a sealant, such as silicone.

Another possible advantage of mounting system 500 is that it may allow an installer to secure a self-rimming sink to a countertop without having to access a fastener at or near the underside of countertop 290. Instead, mounting system 500 may allow an installer to secure a self-rimming sink to a countertop by manipulating a fastener that is conveniently located at a lower portion of the sink (e.g., near the bottom of the basin). In addition to simplifying the installation process by providing second fastener 506 at a lower portion of the sink rather than near an upper portion of the sink, providing second fastener 506 at a lower portion of the sink may also allow manufacturers to increase the footprint of the basin because less clearance us needed between the outer sidewall of the basin and the inner sidewall of the cabinet than would otherwise be needed if an installer had reach his or her hand in this area to access a fastener.

According to another exemplary embodiment, a self-rimming sink may be secured to a cabinet and/or countertop by coupling channel 585 to an underside of rim 430 of sink 400 by first coupling first connector 504 to the first end of linking member 502. With first connector 504 coupled to linking member 502, first connector 504 is slidably engaged into channel 585 such that first connector 504 is at least partially retained relative to the channel. Bracket 583 can then be positioned about a lower end of linking member 502 at a location generally below a projection (e.g., a cleat, etc.) along an inner sidewall of the base cabinet. Bracket 583 is moved upwardly until a first lateral portion or end of bracket 583 engages the underside of the projection and a second end of the bracket engages the underside of the basin floor of sink 400. Second fastener 506 is then coupled to the second end of linking member 502 to at least partially secure bracket 583 relative to the cabinet and sink 400. Appropriate force (e.g., torque) is applied to second fastener to retain sink 400 in the desired position.

Whatever method is being used to secure sink 400 to support structure 200 using mounting assembly 500, one or more additional clamping locations may be provided along channel 585 by providing additional first connectors 504, linking members 502, brackets 583 and second connectors 506 along channel 585. Further, one or more clamping locations are configured to be established on each channel 585 that is coupled to sink 400 (e.g., left channel 585*a*, right channel 585*b*, rear channel 585*c*, etc.). Further still, one or more additional mounting assemblies 500 may be installed either on the same side of the sink or on other sides of the sink. Such additional assemblies may be installed either before or after the securing mechanism is tightened down.

It is also important to note that the construction and arrangement of the elements of the sink as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the enclosure may be constructed from any of a wide variety of materials that provide sufficient strength or durability, in any of a wide variety of colors, textures, and combinations. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present inventions. Other substitutions, modifications, changes, and omissions may be made in the design, operating conditions, and arrangement of the preferred and other exemplary embodiments without departing from the spirit of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the spirit of the appended claims.

What is claimed is:

1. A sink assembly mountable to a support structure comprising a cabinet and a countertop supported by the cabinet, the sink assembly comprising:

a sink comprising at least one basin, a rim that is above and extends outwardly beyond the at least one basin, an apron that extends laterally across and beyond a front of the at least one basin, and a receiving member coupled to a first underside of the sink;

a bracket having a first portion configured to engage a portion of the cabinet and a second portion configured to engage a second underside of the sink; and a connecting member configured to extend between and couple to the receiving member and the bracket to secure the sink to the support structure;

wherein the portion of the cabinet is a cleat extending inwardly from a base of the cabinet.

2. The sink assembly of claim 1, further comprising a first fastener retained by the receiving member and configured to adjustably couple to a first end of the connecting member.

3. The sink assembly of claim 2, further comprising a second fastener configured to adjustably couple to a second end of the connecting member and secure the bracket against the portion of the cabinet and the second underside of the sink.

4. The sink assembly of claim 3, wherein each of the first and second ends of the connecting member comprises threads that thread to threads of the first and second fasteners, respectively.

5. The sink assembly of claim 3, wherein the first underside of the sink is a bottom surface of the rim.

6. The sink assembly of claim 1, wherein the first underside of the sink is a bottom surface of the rim.

7. The sink assembly of claim 6, wherein the second underside of the sink is part of the at least one basin.

8. The sink assembly of claim 7, wherein the second underside of the sink is a bottom surface of a floor of the at least one basin.

9. The sink assembly of claim 7, wherein the receiving member contacts a portion of the at least one basin.

10. The sink assembly of claim 9, wherein the receiving member comprises a top flange, which is coupled to the first underside of the sink, and a side flange, which extends at an angle relative to the top flange and contacts a sidewall of the at least one basin.

11. The sink assembly of claim 1, wherein the apron includes an outside side edge that extends laterally beyond the at least one basin and the receiving member.

12. The sink assembly of claim 11, wherein the outside side edge of the apron extends laterally beyond the connecting member.

13. The sink assembly of claim 12, wherein the outside edge of the apron extends laterally beyond the bracket.

14. A sink assembly mountable to a support structure comprising a cabinet and a countertop supported by the cabinet, the sink assembly comprising:

a sink comprising at least one basin, a rim that is above and extends outwardly beyond the at least one basin, an apron that extends laterally across and beyond a front of the at least one basin, and a receiving member coupled to a first underside of the sink;

a bracket having a first portion configured to engage a portion of the cabinet and a second portion configured to engage a second underside of the sink; and a connecting member configured to extend between and couple to the receiving member and the bracket to secure the sink to the support structure;

wherein the second underside of the sink is a bottom surface of a floor of the at least one basin.

15. The sink assembly of claim 14, wherein the portion of the cabinet is a cleat extending inwardly from a base of the cabinet.

16. The sink assembly of claim 15, wherein the cleat is configured to be located proximate the floor of the at least one basin, the first portion of the bracket engages an underside of the cleat.

17. A method of securing a sink assembly to a support structure comprising a cabinet and a countertop supported by the cabinet, wherein the sink assembly includes a sink having at least one basin, a rim that is above and extends outwardly beyond the at least one basin, an apron that extends laterally across and beyond a front of the at least one basin, and a receiving member coupled to a first underside surface of the sink, the method comprising:

placing the sink on the support structure with the receiving member located between the countertop and the at least one basin;

coupling a first end of a connecting member to the receiving member;

positioning a bracket around the connecting member, such that a first portion of the bracket contacts the support structure, and a second portion of the bracket contacts a second underside surface of the sink; and threading a fastener onto a second end of the connecting member until the bracket is secured to the support structure and the sink;

wherein the second underside surface of the sink is a bottom of a floor of the at least one basin, such that the bracket and the fastener are positioned below the bottom of the at least one basin.

18. The sink assembly of claim 17, wherein the first underside surface of the sink is a bottom of the rim, and the receiving member contacts a sidewall of the at least one basin.

19. A method of securing a sink assembly to a support structure comprising a cabinet and a countertop supported by the cabinet, wherein the sink assembly includes a sink having at least one basin, a rim that is above and extends outwardly beyond the at least one basin, an apron that extends laterally across and beyond a front of the at least one basin, and a receiving member coupled to a first underside surface of the sink, the method comprising:

placing the sink on the support structure with the receiving member located between the countertop and the at least one basin;

coupling a first end of a connecting member to the receiving member;

positioning a bracket around the connecting member, such that a first portion of the bracket contacts the support structure, and a second portion of the bracket contacts a second underside surface of the sink; and threading a fastener onto a second end of the connecting member until the bracket is secured to the support structure and the sink;

wherein the receiving member is a channel having two spaced apart flanges, the first end of the connecting member is coupled to the receiving member through a nut, and the nut is retained by the two flanges of the channel.

20. The sink assembly of claim 19, wherein the second underside surface of the sink is a bottom of a floor of the at least one basin, such that the bracket and the fastener are positioned below the bottom of the at least one basin.

* * * * *